US005967150A

United States Patent [19]

Wright et al.

[11] Patent Number: 5,967,150

[45] Date of Patent: Oct. 19, 1999

[54] RECIPROCATING COMB WITH ANTI-STATIC MEANS

[76] Inventors: Darla Jo Wright, 73 Patricia Ave., Dunedin, Fla. 33020; Robin Elkins, 3389 Sheridan St., Hollywood, Fla. 33021

[21] Appl. No.: 09/148,296

[22] Filed: Sep. 4, 1998

[51] Int. Cl.[6] ..... A45D 24/00; A45D 24/16

[52] U.S. Cl. ..... 132/119.1; 132/120; 132/219

[58] Field of Search ..... 132/119.1, 120, 132/219, 271

[56] References Cited

U.S. PATENT DOCUMENTS

| | | | |
|---|---|---|---|
| 3,150,393 | 9/1964 | Taylor et al. | 132/119.1 |
| 3,204,469 | 9/1965 | Spillers | 132/119.1 |
| 3,272,023 | 9/1966 | Ferguson et al. | 132/119.1 |
| 3,278,963 | 10/1966 | Bond | 132/119.1 |
| 3,384,096 | 5/1968 | Paccione | 132/119.1 |
| 3,897,794 | 8/1975 | Branch | 132/119.1 |
| 4,290,438 | 9/1981 | Price | 132/119.1 |
| 4,549,559 | 10/1985 | Gueret et al. | 132/119.1 |
| 5,150,491 | 9/1992 | Ikemoto | 15/1.52 |

*Primary Examiner*—John J. Wilson
*Assistant Examiner*—Trang Doan
*Attorney, Agent, or Firm*—Smith & Hopen, P.A.; Ronald E. Smith

[57] ABSTRACT

A comb suitable for use as a teasing comb in hair styling is motor-operated so that consistent, high quality results are obtained without tiring the service provider. The motor is light-in-weight and is electrically-powered so that it can be housed in the comb handle. An elongate rocker arm is mounted for pivotal movement so that a leading end of the rocker arm is oscillated when the motor oscillates the trailing end of the rocker arm. The teeth-carrying part of the comb is mounted to the leading end of the rocker arm. At the trailing end of the rocker arm, rotary motion of the motor's output shaft is translated into an oscillating, arcuate motion and at the leading end of the rocker arm, the oscillating, arcuate motion is translated into a straight back-and-forth motion having no arcuate component to simulate a manual teasing motion. In one embodiment, the comb is made of a deionizing material that inhibits the buildup of static electrical charges on the comb as the comb strokes the hair. In another embodiment, the comb is made of a dielectric material sandwiched between conductive, oppositely charged plates. In all embodiments, the speed of the motor may be controlled by suitable speed control circuitry.

11 Claims, 5 Drawing Sheets

RECIPROCATING COMB WITH ANTI-STATIC MEANS

BACKGROUND OF THE INVENTION

1. Field of the Invention

This invention relates, generally, to tools used in the art of hair dressing. More particularly, it relates to a motorized teasing comb built of materials that inhibit generation of static charges as hair is being teased.

2. Description of the Prior Art

Hair teasing is a well-known method of hair styling that is performed with a comb designed especially for that purpose. The service provider manually oscillates the comb over a range of a couple of inches or so in a well-known way to achieve the desired teasing effect.

A number of patents have been awarded on motor-operated teasing combs, but the art remains underdeveloped. For example, the known teasing combs are made of materials that accumulate static charges during the teasing process. The discharges can provide minor but unwanted irritating shocks to the customer or the service provider or both. More importantly, the static build-up can interfere with the combing process itself because the static charge causes hair strands to cling together or to the comb, or both, thereby preventing the hair from being easily combed.

Moreover, most of the known motorized teasing combs have remote motors and thus require an electrical power cord that extends from the remote motor to the comb.

Some of the known combs produce an arcuate path of travel for the comb, which detracts from the suitability of such combs as teasing combs. The known combs that provide a straight back-and-forth motion, i.e., with no arcuate motion, do so by employing relatively complex mechanisms.

What is needed, then, is a motorized teasing comb having a very lightweight motor within the comb body and a simple, inexpensive and reliable means for effecting the required reciprocating motion of the comb. A need also exists for a teasing comb made of materials that inhibit the build-up of static charges during the combing process.

However, in view of the art considered as a whole at the time the present invention was made, it was not obvious to those of ordinary skill in this art how the needed improvements could be provided.

SUMMARY OF THE INVENTION

The long-standing but heretofore unfulfilled need for an apparatus that overcomes the limitations of the prior art is now met by a new, useful, and nonobvious invention.

The present invention discloses for the first time anywhere a hair-treatment apparatus in the form of a self-contained, stand-alone teasing comb having an internal electrically-operated mechanical drive assembly and its own power source.

More particularly, the present invention is a hair-treatment apparatus that includes an elongate rocker arm having a leading end and a trailing end. A pivot means is connected to the rocker arm substantially mid-length thereof so that the rocker arm rocks back-and-forth like a seesaw, its opposite ends oscillating along an arcuate path of travel. A motor means oscillates the trailing end of the rocker arm through the arcuate path of travel at a predetermined rate of oscillations per unit of time. The rocker arm is rigid so the leading end of the rocker arm oscillates in a predetermined, arcuate path of travel at the same predetermined rate of oscillations.

A first translation means translates the rotary motion of the motor's output shaft into the arcuate path of travel, and a second translation means translates the arcuate path of travel of the leading end into a straight back-and-forth motion.

The first translation means includes an elongate, longitudinally extending slot formed in the trailing end of the rocker arm, a transversely disposed pin that extends through that slot, and a radius-defining arm carried by an output shaft of the motor means so that it extends radially relative to an axis of rotation of the output shaft. The transversely disposed pin is mounted on the radius-defining arm near a free end thereof.

Accordingly, rotation of the output shaft causes travel of the pin in a circle having a radius determined by a distance between the axis of rotation of the output shaft and the pin; the pin oscillates within the longitudinally-extending slot and such oscillation causes the trailing end of the rocker arm to oscillate in said arcuate path of travel.

The second translation means includes a mounting means adapted to hold a comb so that the comb is displaced in a straight back-and-forth motion and therefore has utility as a hair-teasing comb. An upstanding guide post is fixedly secured to a predetermined location in closely spaced apart relation to the leading end of the rocker arm, and the mounting means is provided in the form of a slide plate having a bore formed therein for sliding reception of the guide post. The slide plate is fixedly secured to the leading end of the rocker arm. A connecting means loosely connects the slide plate to the leading end of the rocker arm so that the arcuate path of travel of the leading end of the rocker arm is translated into a straight back-and-forth oscillating travel of the slide plate relative to the guide post.

The connecting means includes a longitudinally-extending slot formed in the leading end of the rocker arm and a transversely disposed fastening means that extends through the slot and engages the slide plate so that a straight back-and-forth component of the arcuate path of travel of rocker arm leading end is transmitted to the slide plate and so that an extending and retracting component of the arcuate path of travel is not transmitted to the slide plate.

The inventive comb is a de-ionizing comb because it inhibits the build-up of static charges thereon during the combing process. However, a comb made in accordance with the teachings of this invention need not be restricted to a teasing comb, i.e., a comb having de-ionizing properties has value in many other applications as well, and not just teasing applications.

There are several ways to build a de-ionizing comb. In a first embodiment, an electrically insulating material is formed into the shape of a comb, and that material is disposed in sandwiched relation between a pair of electrically conductive plates that are formed into that shape. The plates are in electrical communication with a source of high voltage, low current electrical power so that formation of a static charge on the comb is inhibited.

In another embodiment, a base means formed of a substantially pure carbon is formed into the shape of a comb so that formation of a static charge on the base means is inhibited. The same effect is attainable by forming the base means of activated charcoal.

In yet another embodiment, a base means formed of a resinous material having substantially equal parts of anions and cations is formed into the shape of a comb so that formation of a static charge on the base means is inhibited.

It is a primary object of this invention to provide a light-in-weight motorized teasing comb having a built-in mechanical drive assembly, a built-in electrically-operated motor and a built-in power source for that motor so that the unit is self-contained and stand-alone.

Another important object is to provide an elegant, effective means for oscillating the comb.

Another significant object is to provide such a comb made of materials that are not subject to the accumulation of static charges thereon.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
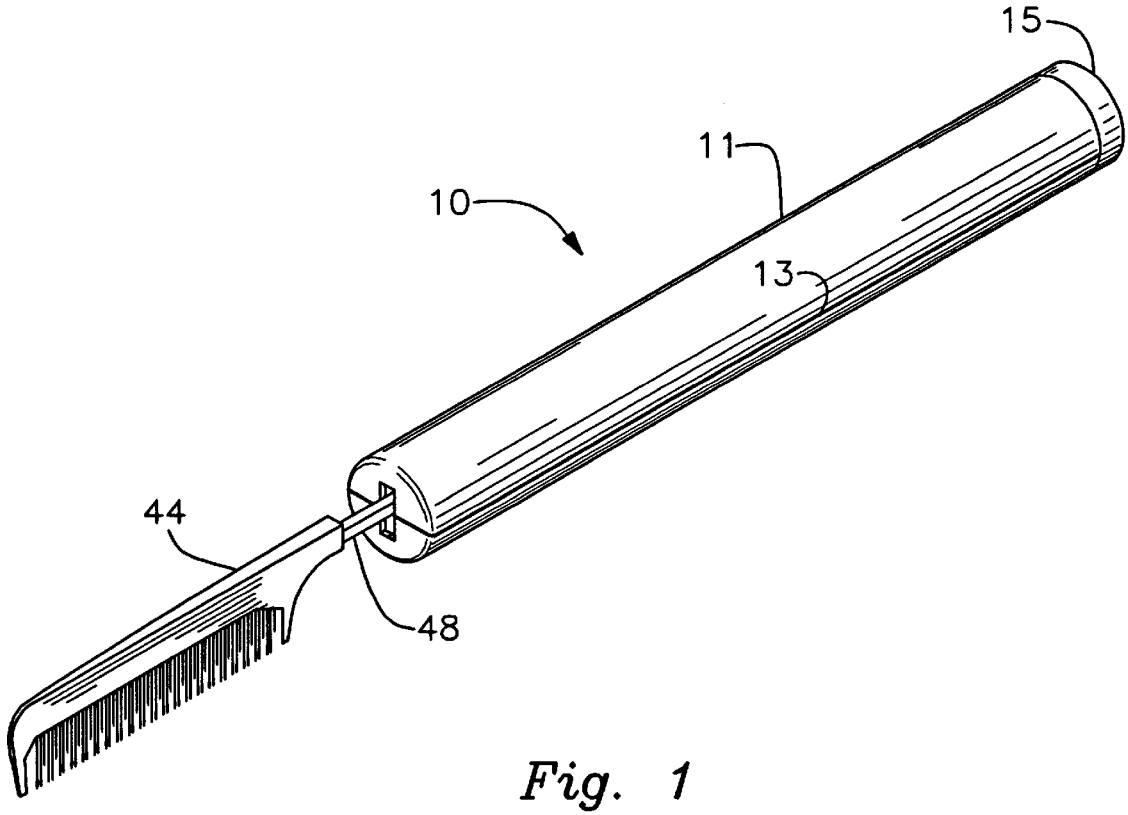
FIG. 1 is a perspective view of an exemplary embodiment of the invention.
Figure 2:
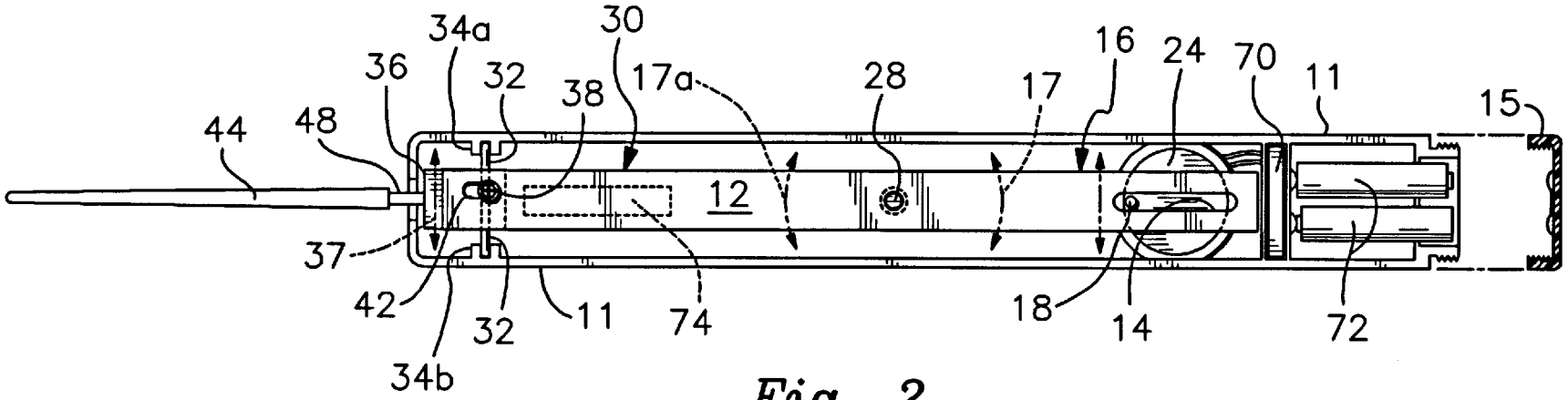
FIG. 2 is a plan view thereof with the top cover removed and with the battery cover depicted in section.
Figure 3:
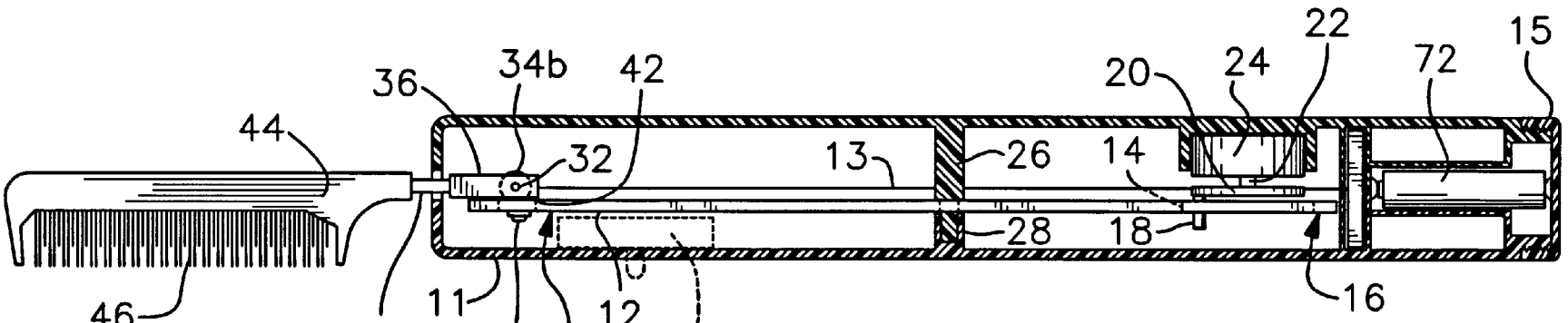
FIG. 3 is a longitudinal sectional view of the housing part of the comb.

Referring now to FIGS. 1–3, it will there be seen that an exemplary embodiment of the invention is denoted as a whole by the reference numeral 10.

Teasing comb 10 includes a hand-held housing or casing 11 that is advantageously formed of two symmetrical parts that meet one another along parting line 13. A removably mounted cap 15 is screw-threaded onto the distal end of housing 11.

Casing 11 houses an elongate, flat rocker arm 12 having an elongate slot 14 formed in a trailing end 16 thereof. Preferably, the longitudinal axis of slot 14 is coincident with a longitudinal axis of symmetry of rocker arm 12.

Truncate pin 18, secured to radius-defining arm 20 in upstanding relation thereto, is transversely disposed relative to rocker arm 12 and extends through slot 14. Pin 18 reciprocates back and forth between opposite ends of slot 14 when output shaft 22 of motor 24 rotates because arm 20 is secured to said output shaft for conjoint rotation therewith.

Motor 24 is preferably an electric motor. A nine volt, battery-powered motor supplied by Edmund Scientific was used in a prototype of the invention.

Radius-defining arm 20 extends radially relative to the axis of rotation of output shaft 22, and pin 18 is mounted to said arm near a free end thereof. Thus, pin 18 is offset from the axis of rotation of output shaft 22 by a distance that predetermines the radius of the circle generated by pin 18 as radius-defining arm 20 rotates. Pin 18 follows a circular, clockwise or counterclockwise path of travel, as viewed in FIG. 2, as output shaft 22 rotates. Such motion oscillates trailing end 16 of rocker arm 12 in an arcuate motion as indicated by double-headed arcuate arrow 17 because said rocker arm is pivotally attached mid-length thereof to pivot plate 26 at pivot pin 28. The arcuate motion is in the plane of the paper as drawn in FIG. 2.

It follows that leading end 30 of rocker arm 12 oscillates in synchronization with trailing end 16, tracing an arcuate path of travel denoted by double-headed directional arrow 17*a,* being in an "up" position when trailing end 16 is in a "down" position, and vice versa.

It should be understood that each arcuate path of travel has two components, i.e., a relatively large straight back-and-forth (or up-and-down as viewed in FIG. 2) component and a relatively small extended-retracted component in a longitudinal direction, said two components being in planes disposed at a right angle to one another.

The reciprocating motion of rocker arm leading end 30 is guided by upstanding post 32 having opposite ends received in upper and lower boss means 34*a,* 34*b* that are advantageously integrally formed with housing 11. A slider plate 36 is secured by a fastening means such as a screw 38 to rocker arm 12. Slider plate 36 has a bore formed therein to slidingly receive post 32; screw 38 does not extend into said bore. A truncate, longitudinally-extending slot 42 formed in rocker arm leading end 30 receives screw 38 and said screw 38 reciprocates back and forth in said slot 42 as leading end 30 of rocker arm 12 oscillates up and down as guided by post 32. More specifically, slider plate 36 and screw 38 oscillate in a vertical plane along the length of post 32; slot 42 allows rocker arm 12 to slide with respect to screw 38, thereby translating the oscillating arcuate motion of the rocker arm into a nonarcuate, straight up and down motion of slide plate 36 and screw 38, as indicated by double-headed directional arrow 37 in FIG. 2.

Novel deionizing comb 44 includes teeth 46 and a base 48 that may be permanently attached to slider plate 36 or detachably secured thereto with a set screw, not shown. Comb 44 oscillates conjointly with slide plate 36, i.e., it follows a straight back and forth path of travel (straight up-and-down as drawn in FIG. 2) and does not follow an arcuate path of travel like the opposite ends of rocker arm 12.

Comb 44 may be made of a deionizing material such as activated charcoal, substantially pure carbon or a resinous material including a substantially equal mixture of anion resin and cation resin. The de-ionizing material is molded into the shape of a comb. Alternatively, it can be obtained as a slab, block, sheet, or other pre-formed shape and then cut into the desired form of a comb. These de-ionizing materials are light-in-weight and immediately dissipate any static charge that might build up as the teeth of the comb tease or otherwise manipulate the hair.

Figure 4:
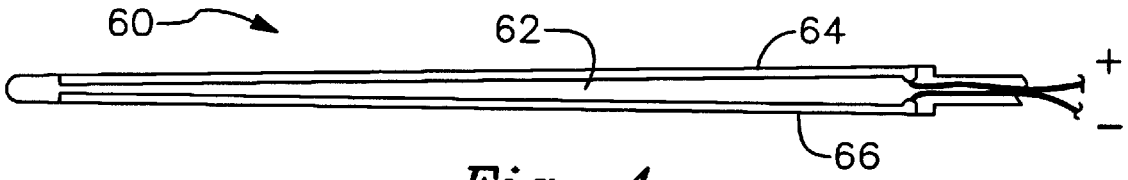
FIG. 4 is a plan view of a deionizing comb made of a dielectric material that is sandwiched between two electrically-conductive plates to which opposite charges are applied.

FIG. 4 depicts another embodiment of a deionizing comb; this embodiment is denoted 60 as a whole. It includes a base 62 in the shape of a comb; the base may be made of air, plastic, or some other suitable dielectric material. Insulating base 62 is disposed in sandwiched relation to a pair of electrically-conductive flat plates 64, 66 which are shaped to conform to the comb-shape of base 60. High voltage, low current electrical power is applied to the plates as depicted to deionize the comb.

Motor 24 may be a single speed motor. Slightly more expensive embodiments might advantageously employ a commercially-available speed control means having a high speed and a low speed, or a high, medium and low speed. An infinitely-adjustable speed control means might also be employed; such speed control means are also well-known and commercially available.

Figure 5:
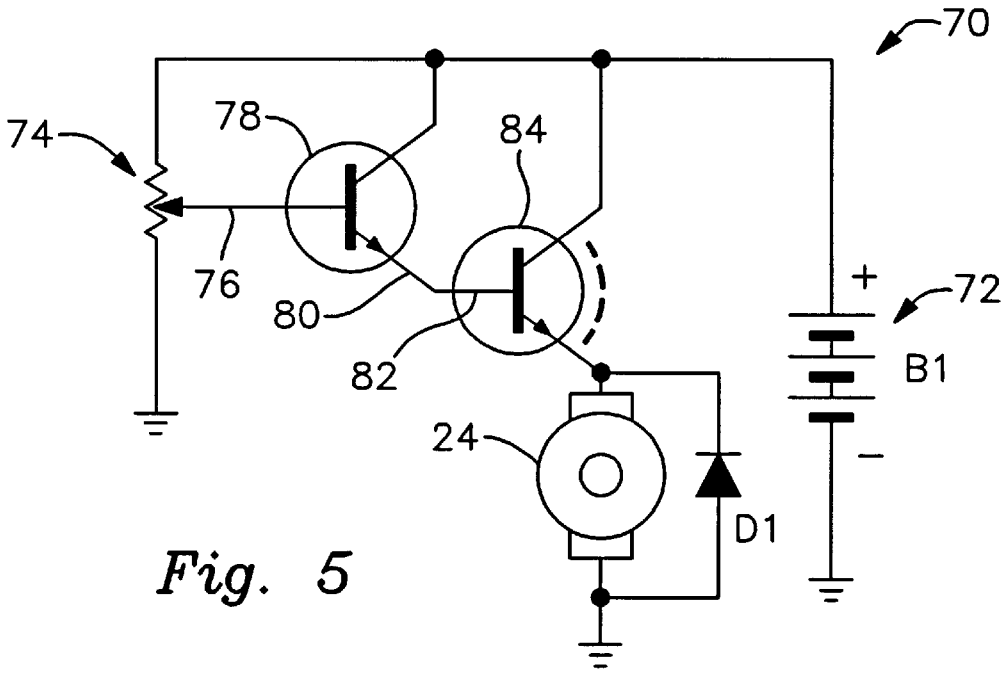
FIG. 5 is a schematic diagram of a first optional motor speed control means.

One such infinitely-adjustable speed control means is depicted in FIG. 5 and is commercially available from Elk Industries of Hollywood, Fla. Motor speed control means 70 is categorized as a Darlington configuration; it includes a D.C. battery 72 connected in electrical parallel relation to a potentiometer means 74 having a resistance range from 10K to 100K ohms. The tapped voltage is applied to the base 76 of a 2N2222 or 2N3904 NPN transistor 78 or equivalent and the emitter 80 of that transistor is electrically connected to base 82 of 2N3055 or MJE3055 NPN transistor 84 or equivalent; a heat sink is required. The amplified voltage is applied across D.C. motor 24. IN4004 diode 76 is a reverse EMF clamping diode, i.e., it blocks back electromotive force to protect motor 24. In the embodiment of FIGS. 1–3, the respective contacts of batteries 72 are held in electrical contact with circuit 70 by end cap 15 in a well-known way as depicted.

Figure 6:
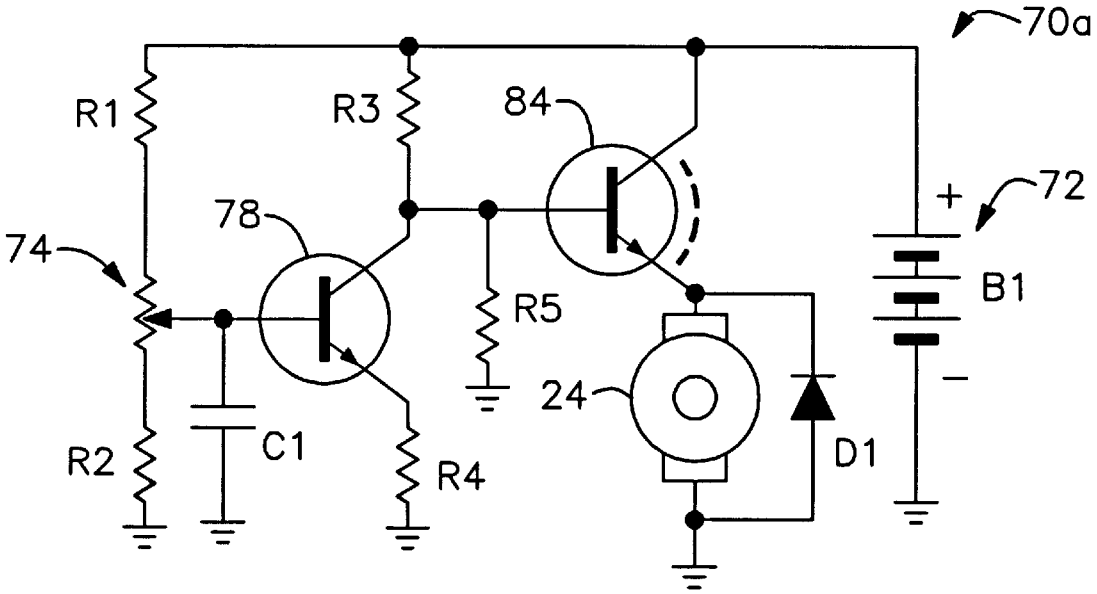
FIG. 6 is a schematic diagram of a second optional motor speed control means.
Figure 7:
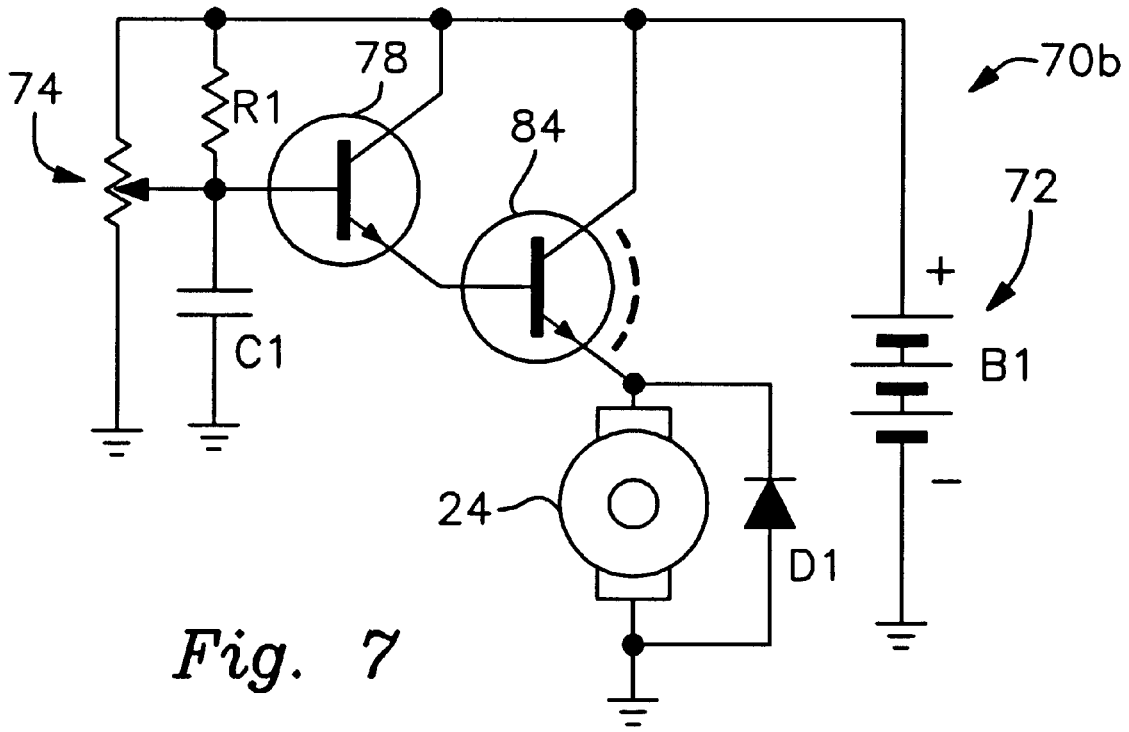
FIG. 7 is a schematic diagram of a third optional motor speed control means.

FIGS. 6 and 7 depict variations of the speed control means. The first variation is denoted 70*a* as a whole in FIG. 6 and the second variation is denoted 70*b* as a whole in FIG. 7. In FIG. 7, resistor R1 and capacitor C1 are electrically connected in parallel relation to one another across base 76 of transistor 78. This arrangement prevents the supply voltage from being fed to motor 24, said supply voltage being delivered to motor 24 if the wiper of the potentiometer slides across the ceramic resistive element of the potentiometer and is momentarily disconnected therefrom due to mechanical imperfections in the wiper or the resistive element or both.

The novel deionizing comb is free from static build-up. The internal motor, internal power supply, internal speed control means, and the internal simple mechanical means for translating the rocking action of the leading end of the rocker arm into a straight back-and-forth motion are collectively very light-in-weight and economical to manufacture. Moreover, the self-contained, stand-alone aspect of the invention eliminates the need for an electrical power cord. The operation is so quiet that a customer might not notice that a motorized comb is being employed. The consistency of the results, however, surpass those of a skilled service provider. Use of the novel comb does not tire the service provider because there is no need to manually oscillate the comb.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A hair-treatment apparatus, comprising:

an elongate rocker arm having a leading end and a trailing end;

a pivot means connected to said rocker arm substantially mid-length thereof;

a motor means for oscillating said trailing end of said rocker arm through a predetermined, arcuate path of travel at a predetermined rate of oscillations per unit of time so that said leading end of said rocker arm oscillates in a predetermined, arcuate path of travel at said predetermined rate of oscillation;

a first translation means for translating a rotary output of said motor means into said arcuate path of travel of said trailing end;

an elongate, longitudinally-extending slot formed in said trailing end of said rocker arm;

a transversely disposed pin that extends through said slot;

a radius-defining arm carried by an output shaft of said motor means so that it extends radially relative to an axis of rotation of said output shaft;

said transversely disposed pin being mounted on said radius-defining arm near a free end thereof;

a second translating means for translating the arcuate path of travel of said leading end into a straight back-and-forth motion;

said second translating means including a mounting means adapted to hold a comb so that said comb is displaced in a straight back-and-forth motion so that said comb has utility as a hair-teasing comb;

whereby rotation of said output shaft causes travel of said pin in a circle having a radius determined by a distance between said axis of rotation of said output shaft and said pin, said pin oscillating within said longitudinally-extending slot and oscillating said trailing end of said rocker arm in said arcuate path of travel.

2. The apparatus of claim 1, said second translating means comprising:

an upstanding guide post fixedly secured to a predetermined location in closely spaced apart relation to said leading end of said rocker arm;

said mounting means provided in the form of a slide plate having a bore formed therein for sliding reception of said guide post, said slide plate being fixedly secured to said leading end of said rocker arm; and connecting means for loosely connecting said slide plate to said leading end of said rocker arm so that said arcuate path of travel of said leading end of said rocker arm is translated into a straight back-and-forth oscillating travel of said slide plate relative to said guide post.

3. The apparatus of claim 2, wherein said connecting means includes a longitudinally-extending slot formed in said leading end of said rocker arm and a fastening means that extends through said slot and engages said slide plate so that a straight back-and-forth component of said arcuate path of travel of said leading end of the rocker arm is transmitted to said slide plate and so that an extending and retracting component of said arcuate path of travel is not transmitted to said slide plate.

4. The apparatus of claim 1, wherein said motor means is an electric motor.

5. The apparatus of claim 4, wherein said electric motor is a nine volt battery-powered motor.

6. The apparatus of claim 4, further comprising a speed control means for controlling the speed of said motor means.

7. The apparatus of claim 6, wherein said speed control means is infinitely adjustable.

8. The apparatus of claim 1, wherein said comb is made of a deionizing material that inhibits build-up of a static electricity charge thereon as said comb is oscillated with respect to said hair.

9. The apparatus of claim 8, wherein said deionizing material is activated charcoal.

10. The apparatus of claim 8, wherein said deionizing material is substantially pure carbon.

11. The apparatus of claim 8, wherein said deionizing material is a resinous material having substantially equal parts of anions and cations.

* * * * *